US009318296B2

(12) United States Patent
Fox et al.

(10) Patent No.: US 9,318,296 B2
(45) Date of Patent: Apr. 19, 2016

(54) MAGNETRON

(75) Inventors: David Bernard Fox, Chelmsford (GB); Timothy Peter Fox, Chelmsford (GB); Scott Williams, Brightlingsea (GB)

(73) Assignee: E2V Technologies (UK) Limited, Chelmsford (GB)

( * ) Notice: Subject to any disclaimer, the term of this patent is extended or adjusted under 35 U.S.C. 154(b) by 84 days.

(21) Appl. No.: 13/423,833

(22) Filed: Mar. 19, 2012

(65) Prior Publication Data

US 2012/0235564 A1 Sep. 20, 2012

(30) Foreign Application Priority Data

Mar. 17, 2011 (GB) ..... 1104516.8

(51) Int. Cl.
*H01J 23/04* (2006.01)
*H01J 25/50* (2006.01)

(52) U.S. Cl.
CPC *H01J 25/50* (2013.01); *H01J 23/04* (2013.01)

(58) Field of Classification Search
CPC ..... H01J 25/50; H01J 23/05
USPC ..... 315/39.51
See application file for complete search history.

(56) References Cited

U.S. PATENT DOCUMENTS

| | | | | |
|---|---|---|---|---|
| 2,431,139 | A * | 11/1947 | Retherford et al. | 315/39 |
| 2,437,880 | A * | 3/1948 | Kusch | 313/151 |
| 3,716,750 | A * | 2/1973 | Nakada et al. | 315/39.71 |
| 5,180,946 | A * | 1/1993 | Aiga et al. | 315/39.51 |
| 5,508,583 | A | 4/1996 | Lee | |
| 7,026,762 | B2 * | 4/2006 | Shon et al. | 315/39.51 |
| 7,365,291 | B2 * | 4/2008 | Lee et al. | 219/697 |
| 2005/0012461 | A1 * | 1/2005 | Yang | 315/39.51 |
| 2009/0236991 | A1 * | 9/2009 | Wilson | 315/94 |

FOREIGN PATENT DOCUMENTS

| | | | |
|---|---|---|---|
| CN | 201374306 | Y | 12/2009 |
| EP | 1505628 | A2 | 2/2005 |
| EP | 1551053 | A2 | 7/2005 |
| GB | 2 259 181 | A | 3/1993 |
| JP | 61-034828 | A | 2/1986 |
| JP | 64-045042 | A | 2/1989 |
| JP | 2-297838 | A | 10/2002 |

OTHER PUBLICATIONS

Great Britain Search Report issued in Great Britain Patent Application No. 1104516.8, dated Jul. 15, 2011.

French Search Report and Written Opinion dated May 26, 2015, issued in corresponding French Application No. 12 52343.

* cited by examiner

*Primary Examiner* — Alexander H Taningco
*Assistant Examiner* — David Lotter
(74) *Attorney, Agent, or Firm* — FisherBroyles LLP; Robert Kinberg

(57) ABSTRACT

A cathode of a magnetron having a radial extension to accommodate the cathode terminals is supported by arms which have a greater diameter over the region in which they are supported in the glass thimble than over the region of the free ends. This shifts any vibrations to a higher frequency band, which is less liable to be excited in the event the magnetron is moved rapidly as in a linac used for radiotherapy purposes.

5 Claims, 4 Drawing Sheets

MAGNETRON

CROSS-REFERENCE TO RELATED APPLICATIONS

This application claims priority from United Kingdom patent application number GB 1104516.8 filed Mar. 17, 2011, the contents of which are incorporated herein by reference in its entirety.

FIELD OF THE INVENTION

This invention relates to magnetrons.

BACKGROUND OF THE INVENTION

Magnetrons are used in linear accelerator systems (linacs) to generate X-rays, and one use of such linacs is to generate X-rays for the treatment of tumours in radiotherapy. In an attempt to deliver the optimum dose of radiation to a tumour, linacs are being mounted on gantries which rotate around the patient, sometimes at high speed, while the X-ray dose is being delivered. This occasionally causes a problem, in that to achieve optimum performance the cathode must be held in a precise position in a hollow cylindrical anode with a high voltage between the anode and cathode. The cathode may be supported on a pair of electrically conducting arms which are anchored into the vacuum envelope at their ends.

Thus, referring to FIGS. 1 and 1*a*, which are, respectively, a schematic fragmentary axial cross-section through a radially-extending portion of a known magnetron and a fragmentary end view of the interior of the anode, the cathode 1 is supported in a hollow cylindrical anode 2 by means of tungsten support arms 3, 4. The radially-extending portion of the vacuum envelope, generally termed a sidearm, is indicated generally by the reference numeral 5, and carries on its exterior the cathode terminals 6, 7 across which a DC heater voltage for the cathode is applied, superimposed on the high negative voltage required for operation of the magnetron. The main body 8 of the magnetron is made of metal, and has channels 9, 10 to accommodate the support arms 3, 4. The radially-extending portion includes a metal ring 11, which is welded to the main body 8, and glass thimble 12 which is bonded to the metal ring. The support arms 3, 4 are secured in a vacuum-tight fashion in apertures in the dished upper end 13 (as seen in the drawing) of the thimble, and form the cathode terminals 6, 7. At the lower end, as seen in FIG. 1, the cathode support arms are connected to opposite ends of the cathode 1 by means of leads 16, 17. The cathode support arms 3, 4 terminate short of the cylindrical anode space 2, to allow room for the cathode to be inserted in an axial direction during manufacture (see FIG. 1*a*), and the leads are only connected when the cathode has been assembled into the anode space. The lead 16 at one end may be v-shaped, the apex being connected to the cathode support arm 3, and the ends of the limbs being connected to the cathode. The lead 17 at the other end may be a conductor bent into parallel strands and connected to a heater lead extending from the other end of the cathode through an insulating collar (not shown, but illustrated in our US patent publication no. 2009/0236991).

It is believed that in some instances, the support arms 3, 4 pick up mechanical vibrations, which can impair the correct functioning of the magnetron.

BRIEF SUMMARY OF THE INVENTION

The invention provides a magnetron in which the vacuum envelope includes a glass portion which extends radially relative to the axis of the cathode, a pair of electrically conducting support arms mounted in a vacuum-tight fashion in the glass portion, the free ends of which are connected to leads connected to the cathode, wherein the diameter of the support arms over the region of mounting in the glass portion is greater than that at the free ends.

The support arms may taper from the region over which they are mounted to the free ends, or over a portion of that length, or may be stepped in diameter. Such a shape may be formed by grinding.

The support arms preferably terminate outside the projection of the cylindrical anode profile, and leads, which may be of nickel wire, are welded or brazed to make the connection between the cathode and the cathode support arms during assembly of the magnetron.

Ways of carrying out the invention will now be described in detail, by way of example, with reference to the accompanying drawings, in which:

BRIEF DESCRIPTION OF THE DRAWINGS

Like reference numerals have been given to like parts throughout all the Figures.

DETAILED DESCRIPTION OF AN EMBODIMENT OF THE INVENTION

Figure 1:
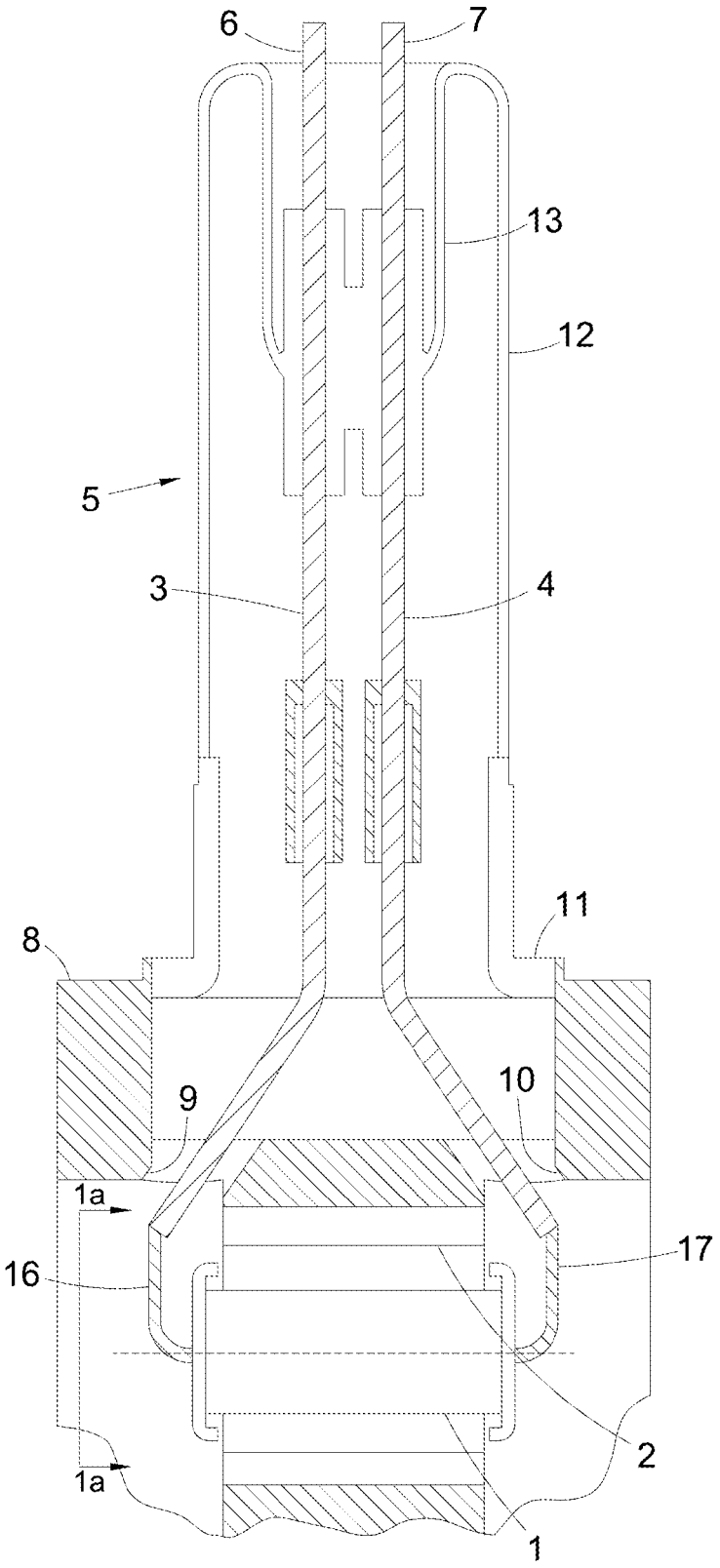
Fig. 1 PRIOR ART
FIG. 1 is a cross-section of a radially-extending part of a known magnetron.

The magnetron of the invention differs from the known magnetron of FIG. 1 in the construction of the radially-extending portion 5 of the vacuum envelope, and specifically in the mounting of the cathode.

Figure 1A:
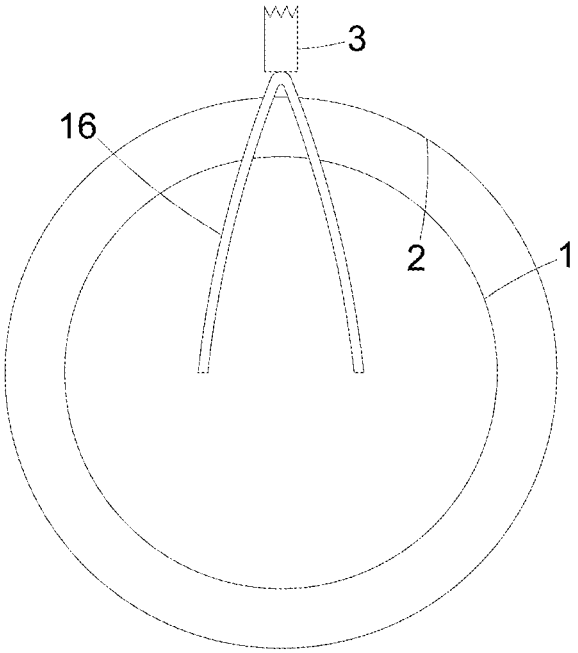
Fig. 1a PRIOR ART
FIG. 1*a* is an end view of a fragment of the interior of the anode, looking along the lines 1*a*-1*a* in FIG. 1.
Figure 2:
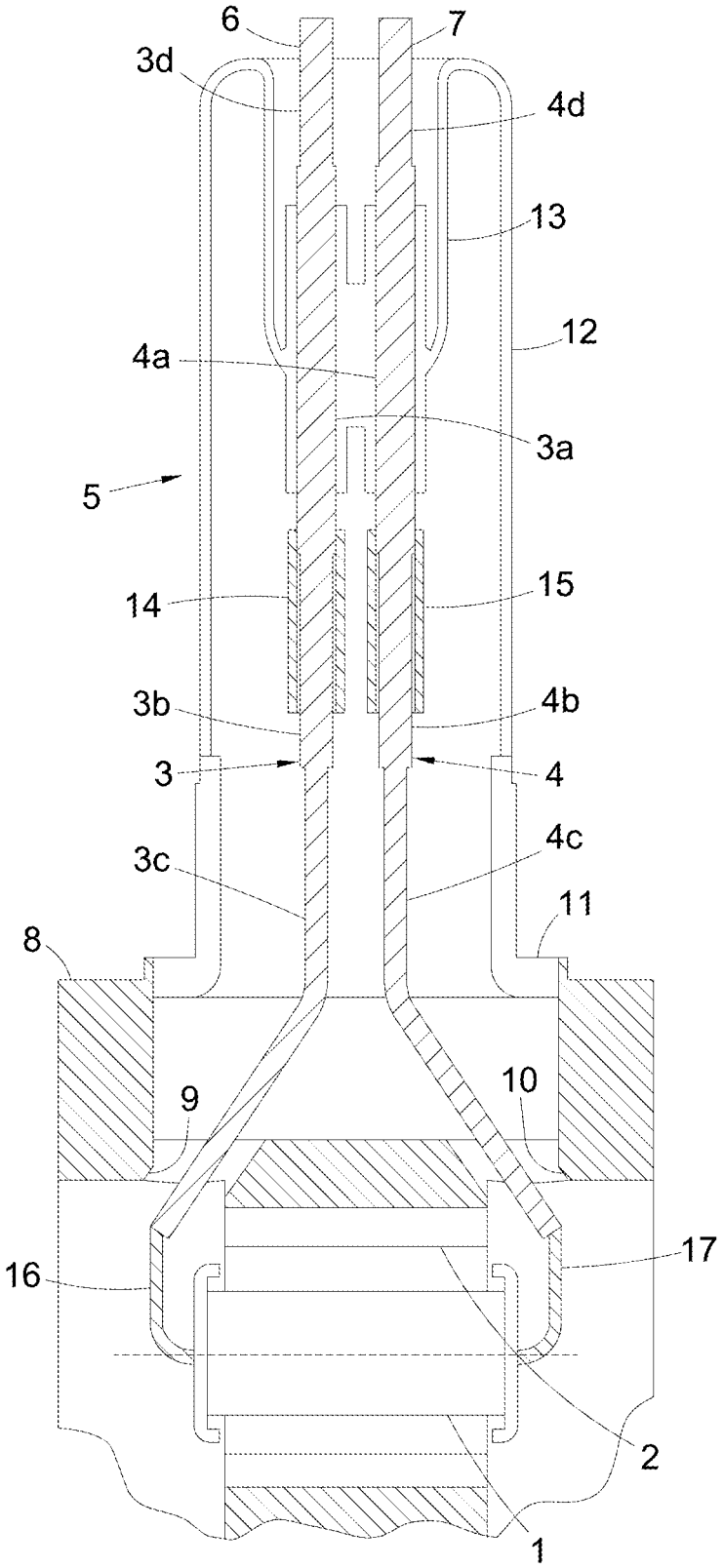
FIG. 2 is a cross-section of a radially-extending part of a magnetron according to a first embodiment of the invention.

Referring to FIG. 2, the support arms indicated generally by the reference numerals 3, 4 are stepped in diameter over their length. The roots of the support arms 3*a*, 4*a* have the thickest diameter, and this is the region over which the arms are mounted in the glass thimble 12 in a vacuum-tight fashion. The next adjacent regions 3*b*, 4*b*, 3*d*, 4*d* are thinner in diameter, and the regions 3*c*, 4*c* are thinnest in diameter. At the free ends of the thinnest region, the cathode is supported via leads 16, 17 connected during assembly of the magnetron, in the manner shown in FIG. 1*a*.

At the free ends, the diameter of the support arms is the same as in the prior art construction, because there is a limited clearance between the arms, which are at a high negative voltage, and the channels 9, 10 in the anode body 8, which is grounded. However, the diameter is stepped up to the greatest value in the region which is supported in the glass envelope.

It is believed that the resonance of the support arms is thereby increased in frequency compared to the prior art arrangement in FIG. 1, and while the support arm has been found to resonate at around 50 Hz in known magnetrons, this resonance has been found to move to around 100 Hz in the magnetron according to the invention.

Sleeves 14, 15 are brazed to the central section 3*a*, 4*a* and extend over the thinner section 3*b*, 4*b*. The hollow sleeves 14,

15 are quarter-wavelength in length, and form RF chokes which prevent leakage of RF along the cathode support arms 3, 4.

The stepped arms may be made by grinding down a tungsten rod having the thickest diameter 3*a*, 4*a*, but could if desired be made by joining together separate sections each of the desired thickness.

Figure 3:
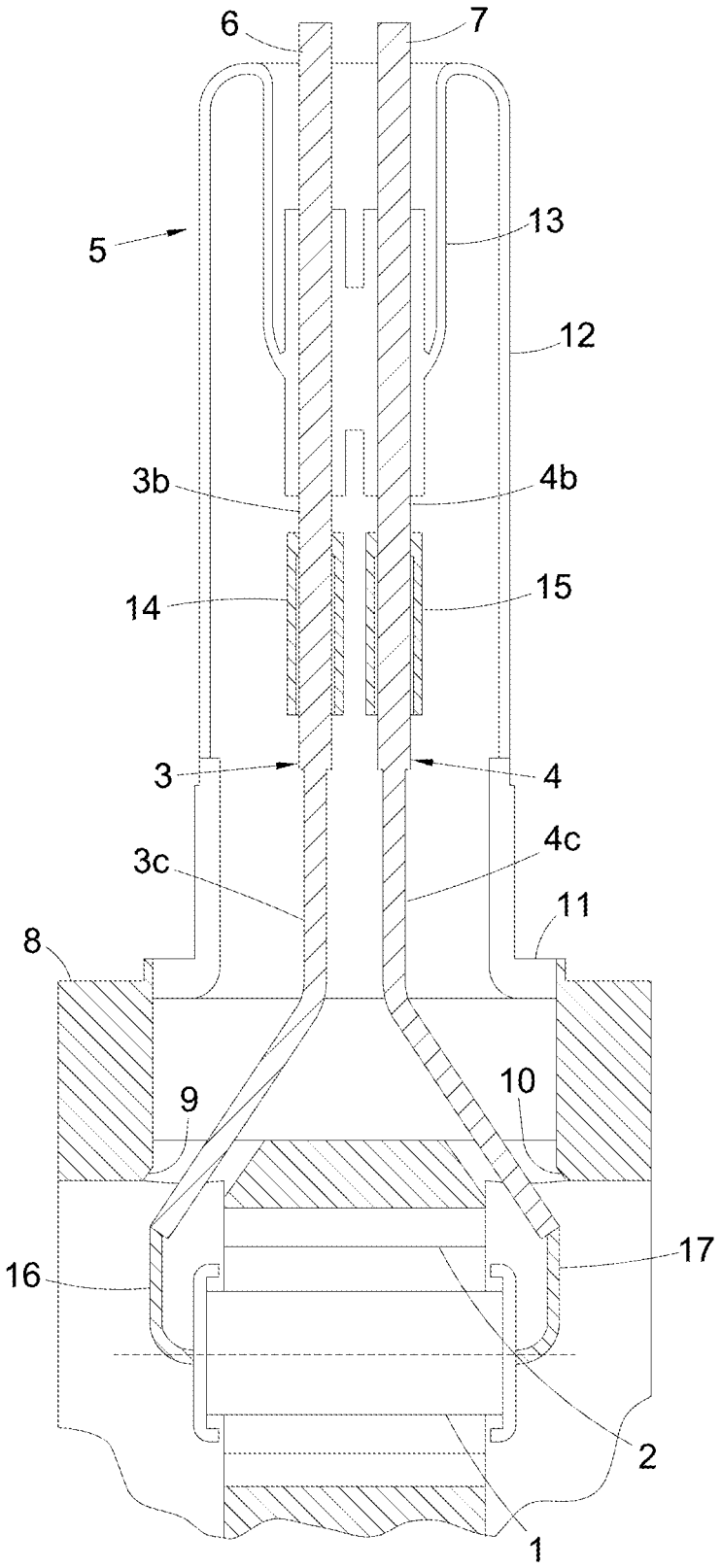
FIG. 3 is a cross-section of a radially-extending part of a magnetron according to a second embodiment of the invention.

Referring to FIG. 3, the support arms 3, 4 are stepped in diameter, but only have a thicker region 3*b*, 4*b* and a thinner region 3*c*, 4*c*. The arms are supported in the glass thimble 12 over the thicker region, which stiffens the support arms, and increases their resonant frequency.

Sleeves 14, 15 are brazed to the support arms to form quarter wavelength RF chokes.

Suitable materials for the cathode support arms 3, 4 are tungsten, molybdenum or other high temperature alloys. The choice of glass type needs to be compatible with substrate material.

Of course, variations may be made to the embodiment described without departing from the scope of the invention. Thus, instead of the support arms 3, 4 being stepped in diameter, they could be tapered from the region over which they are mounted in the glass thimble, to the free ends, or tapered over a portion of that length. The tapering could be produced by a grinding operation.

The invention is especially suitable for magnetrons with peak output powers exceeding 2 MW. A typical range of operating frequencies is from 2850 MHz to 3010 MHz, the design being especially suitable for 2993 MHz to 3002 MHz.

The invention has been described in detail with respect to various embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A magnetron, comprising:

a cathode having an axis;

a vacuum envelope including a glass portion extending radially relative to the axis of the cathode;

an anode having a cylindrical anode wall surrounding the cathode;

a pair of electrically conducting support arms mounted vacuum-tight in a wall of the glass portion of the vacuum envelope and having free ends located exterior to the cylindrical anode wall; and leads connecting the free ends of the support arms to the cathode, the support arms supporting the cathode via the leads, wherein each of the support arms has a first portion having a first diameter extending over a region of mounting in the glass portion, and each of the support arms has a second portion extending from the free ends to the first portion and having a second diameter that is smaller than the first diameter thereby to increase a resonant frequency of the support arms.

2. The magnetron as claimed in claim 1, wherein each of the support arms is stepped in diameter.

3. The magnetron as claimed in claim 2, further comprising sleeves connected to a region of greater diameter of the support arms and extending over a region of lesser diameter, to form quarter wavelength chokes.

4. The magnetron as claimed in claim 1, wherein the support arms include at least one region of tapering diameter.

5. The magnetron as claimed in claim 1, wherein the support arms terminate outside a profile of an interior of the anode, and the cathode leads are connected during assembly.

* * * * *